US010411384B1

(12) United States Patent
Machida et al.

(10) Patent No.: US 10,411,384 B1
(45) Date of Patent: Sep. 10, 2019

(54) CONNECTION TERMINAL WITH A CONTACT MEMBER THAT IS INHIBITED FROM FLOATING RELATIVE TO AN INNER CIRCUMFERENTIAL FACE OF A FEMALE CONNECTOR

(71) Applicant: Yazaki Corporation, Tokyo (JP)

(72) Inventors: Kengo Machida, Shizuoka (JP); Yasuhiro Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/946,608

(22) Filed: Apr. 5, 2018

(30) Foreign Application Priority Data

Mar. 1, 2018 (JP) ..... 2018-036065

(51) Int. Cl.
*H01R 13/187* (2006.01)
*H01R 4/18* (2006.01)

(52) U.S. Cl.
CPC ..... *H01R 13/187* (2013.01); *H01R 4/184* (2013.01)

(58) Field of Classification Search
CPC .... H01R 13/187; H01R 13/052; H01R 13/10; H01R 4/184
USPC ..... 439/816, 843, 850–852, 252, 844, 846, 439/847
See application file for complete search history.

(56) References Cited

U.S. PATENT DOCUMENTS 3,861,776 A * 1/1975 Deal ..... H01R 13/187 439/380
5,088,942 A 2/1992 Welsh et al.
6,250,974 B1 6/2001 Kerek
6,296,519 B1 10/2001 Hashizawa et al.
9,236,682 B2 * 1/2016 Glick ..... H01R 13/62
9,608,341 B2 3/2017 Saur et al.
2003/0077950 A1 * 4/2003 Swearingen ..... H01R 4/4881 439/843

(Continued)

FOREIGN PATENT DOCUMENTS

DE 691 15 407 T2 7/1996
DE 198 48 344 B4 11/2006

(Continued)

OTHER PUBLICATIONS

German Office Action for the related German Patent Application No. 10 2018 205 307.3 dated Dec. 21, 2018.

*Primary Examiner* — Travis S Chambers
(74) *Attorney, Agent, or Firm* — Kenealy Vaidya LLP

(57) ABSTRACT

A connection terminal includes a terminal main body having a female connector with an internal space into which a male connector is inserted and a contact member accommodated into the internal space of the female connector. The contact member has a first contact electrically connected to the female connector, a second contact coupled to the first contact and pushed outward in a radial direction by the male connector in the internal space to be electrically connected to the male connector, and a floating inhibiting part that applies a pressing force to the female connector, generates a force in a pressing direction toward an inner circumferential face of the female connector by a reaction force from the female connector against the pressing force, and inhibits the floating of the first contact relative to the inner circumferential face of the female connector by the force in the pressing direction.

9 Claims, 14 Drawing Sheets

(56) References Cited

U.S. PATENT DOCUMENTS

| | | | | |
|---|---|---|---|---|
| 2008/0268717 | A1 | 10/2008 | Mao | |
| 2011/0287654 | A1 | 11/2011 | Mittermair et al. | |
| 2016/0087351 | A1* | 3/2016 | Ohkubo ..... | H01R 13/187<br>439/877 |
| 2016/0126651 | A1 | 5/2016 | Hirakawa et al. | |
| 2016/0254610 | A1 | 9/2016 | Hirakawa et al. | |

FOREIGN PATENT DOCUMENTS

| | | | |
|---|---|---|---|
| DE | 10 2015 221 287 | A1 | 5/2016 |
| JP | 5579213 | B2 | 8/2014 |
| JP | 2015-76199 | A | 4/2015 |

* cited by examiner

CONNECTION TERMINAL WITH A CONTACT MEMBER THAT IS INHIBITED FROM FLOATING RELATIVE TO AN INNER CIRCUMFERENTIAL FACE OF A FEMALE CONNECTOR

CROSS-REFERENCE TO RELATED APPLICATION(S)

The present application claims priority to and incorporates by reference the entire contents of Japanese Patent Application No. 2018-036065 filed in Japan on Mar. 1, 2018.

BACKGROUND OF THE INVENTION

1. Field of the Invention

The present invention relates to a connection terminal.

2. Description of the Related Art

Conventionally, there is known is a connection terminal including a terminal main body having a female connector provided with a columnar internal space into which a male connector of a counter male terminal is inserted and a contact member that is accommodated into the internal space and is electrically connected to the female connector and the male connector. This kind of connection terminal is disclosed in Japanese Patent Application Laid-open No. 2015-76199 and Japanese Patent No. 5579213, for example.

In the connection terminal, the contact member is formed in a tubular shape that has elasticity and is provided along an inner circumferential face of the female connector, and when the male connector is inserted into this tubular shape, using its spring force, electric connection between the female connector and the male connector is established. Therefore, in this connection terminal, there is a possibility that the contact member floats relative to the inner circumferential face of the female connector. In addition, in the conventional connection terminal, when the contact member of the tubular shape is inserted into the internal space with its diameter made narrower, for example, there is a case where the contact member is deformed to a plastic region to reduce a spring force against the inner circumferential face of the female connector, and by this reduction in the spring force, the floating of the contact member relative to the inner circumferential face of the female connector may occur. In the conventional connection terminal, owing to such floating of the contact member, the male connector, when it is inserted, may collide with the contact member to cause a reduction in durability, a reduction in insertion workability for the male connector, and the like.

SUMMARY OF HE INVENTION

An object of the present invention is therefore to provide a connection terminal in which a contact member is inhibited from floating relative to an inner circumferential face of a female connector.

In order to achieve the above mentioned object, a connection terminal according to one aspect of the present invention includes a terminal main body that is made of a conductive material and has a female connector provided with a cylindrical internal space into which a male connector of a counter male terminal is inserted and a wire connector to which a conducting part of a wire is electrically connected, and a contact member that is made of a conductive material, is accommodated into the internal space along an inner circumferential face of the female connector and is electrically connected to the female connector, and is electrically connected to the male connector inserted into the internal space, wherein the contact member includes a first contact that is formed in an arcuate shape in a circumferential direction of the inner circumferential face of the female connector and is electrically connected to the inner circumferential face of the female connector on an outer circumferential face side of the arcuate shape, a second contact that is arranged in the internal space while being coupled to the first contact, is pushed outward in a radial direction of the internal space by the male connector inserted into the internal space, and is electrically connected to the male connector; and a floating inhibiting part that is formed in an arcuate shape in the circumferential direction of the inner circumferential face of the female connector, and that applies a pressing force corresponding to a resilient force generated according to a change in a curvature of the arcuate shape to the female connector, generates a force in a pressing direction toward the inner circumferential face of the female connector by input of a reaction force from the female connector against the pressing force, and inhibits floating of the first contact relative to the inner circumferential face of the female connector using the force in the pressing direction.

According to another aspect of the present invention, in the connection terminal, the contact member may have at least two first contacts arranged to be spaced apart from each other in an axial direction of the female connector and have a plurality of second contacts as coupling parts that couple two adjacent first contacts, and the second contacts may be formed in an arcuate shape protruding inward in the radial direction between the two adjacent first contacts so as to be bent outward in the radial direction when being pushed outward in the radial direction by the male connector inserted into the internal space.

According to still another aspect of the present invention, in the connection terminal, the contact member may have each of a first locked part and a second locked part by at least one, that are configured to protrude outward in the radial direction, and the female connector may have an insertion direction locking part that locks the first locked part in an insertion direction of the male connector relative to the internal space and a removal direction locking part that locks the second locked part in a removal direction of the male connector relative to the internal space.

According to still another aspect of the present invention, in the connection terminal, the female connector may include a first receiving part that locks a first force applying part at one end in the circumferential direction of the floating inhibiting part and receives the pressing force from the first force applying part and applies the reaction force against the pressing force to the first force applying part, and a second receiving part that locks a second force applying part at another end in the circumferential direction of the floating inhibiting part and receives the pressing force from the second force applying part and applies the reaction force against the pressing force to the second force applying part.

According to still another aspect of the present invention, in the connection terminal, the floating inhibiting part may have the first force applying part configured to protrude outward in the radial direction from the one end in the circumferential direction and the second force applying part configured to protrude outward in the radial direction from the other end in the circumferential direction, and the floating inhibiting part may be accommodated into the internal space with the curvature made smaller to generate the resilient force and may apply the respective pressing forces in the circumferential direction to the first receiving part and the second receiving part from the first force applying point and the second force applying point, respectively.

According to still another aspect of the present invention, in the connection terminal, the floating inhibiting part may be formed so as to have a central angle with respect to an arc, which is larger than 180 degrees and may have the first force applying part configured to protrude outward in the radial direction from the one end in the circumferential direction and the second force applying part configured to protrude outward in the radial direction from the other end in the circumferential direction, and the floating inhibiting part may be accommodated into the internal space with the curvature made larger to generate the resilient force and may apply the respective pressing forces in the circumferential direction to the first receiving part and the second receiving part from the first force applying point and the second force applying point, respectively.

According to still another aspect of the present invention, in the connection terminal, the floating inhibiting part may be formed so as to have a central angle with respect to an arc, which is larger than 180 degrees and may have the first force applying part swelled outward in the radial direction at the one end in the circumferential direction and the second force applying part swelled outward in the radial direction at the other end in the circumferential direction, and the floating inhibiting part may be accommodated into the internal space with the curvature made larger to generate the resilient force and may apply the respective pressing forces outward in the radial direction to the first receiving part and the second receiving part from the first force applying point and the second force applying point, respectively.

The above and other objects, features, advantages and technical and industrial significance of this invention will be better understood by reading the following detailed description of presently preferred embodiment of the invention, when considered in connection with the accompanying drawings.

DETAILED DESCRIPTION OF THE PREFERRED EMBODIMENTS

The following describes an embodiment of a connection terminal according to the present invention in detail with reference to the accompanying drawings. This embodiment does not limit this invention.

Embodiment

The following describes an embodiment of the connection terminal according to the present invention with reference to FIG. 1 to FIG. 14.

Figure 1:
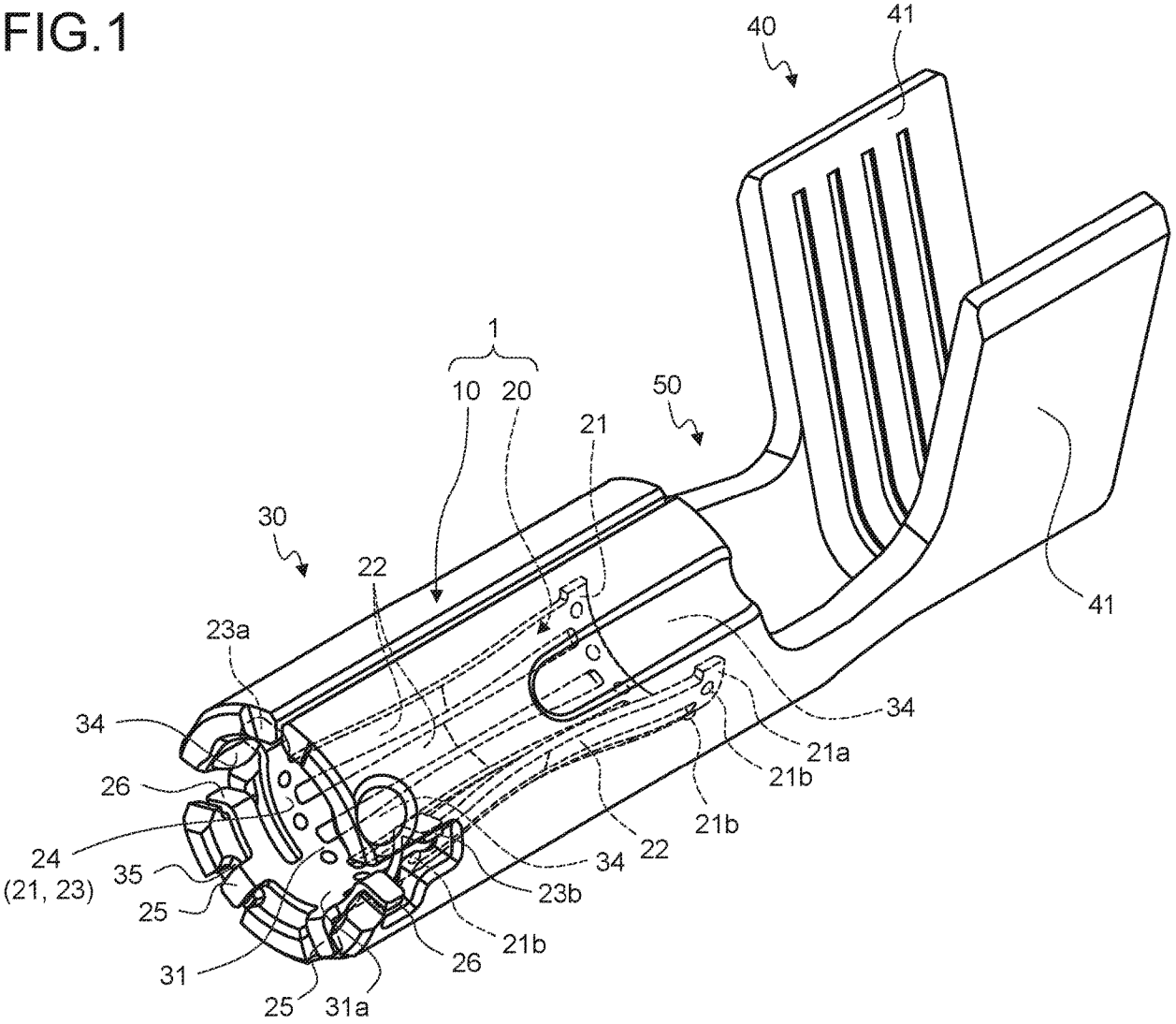
FIG. 1 is a perspective view of a connection terminal of an embodiment.
Figure 2:
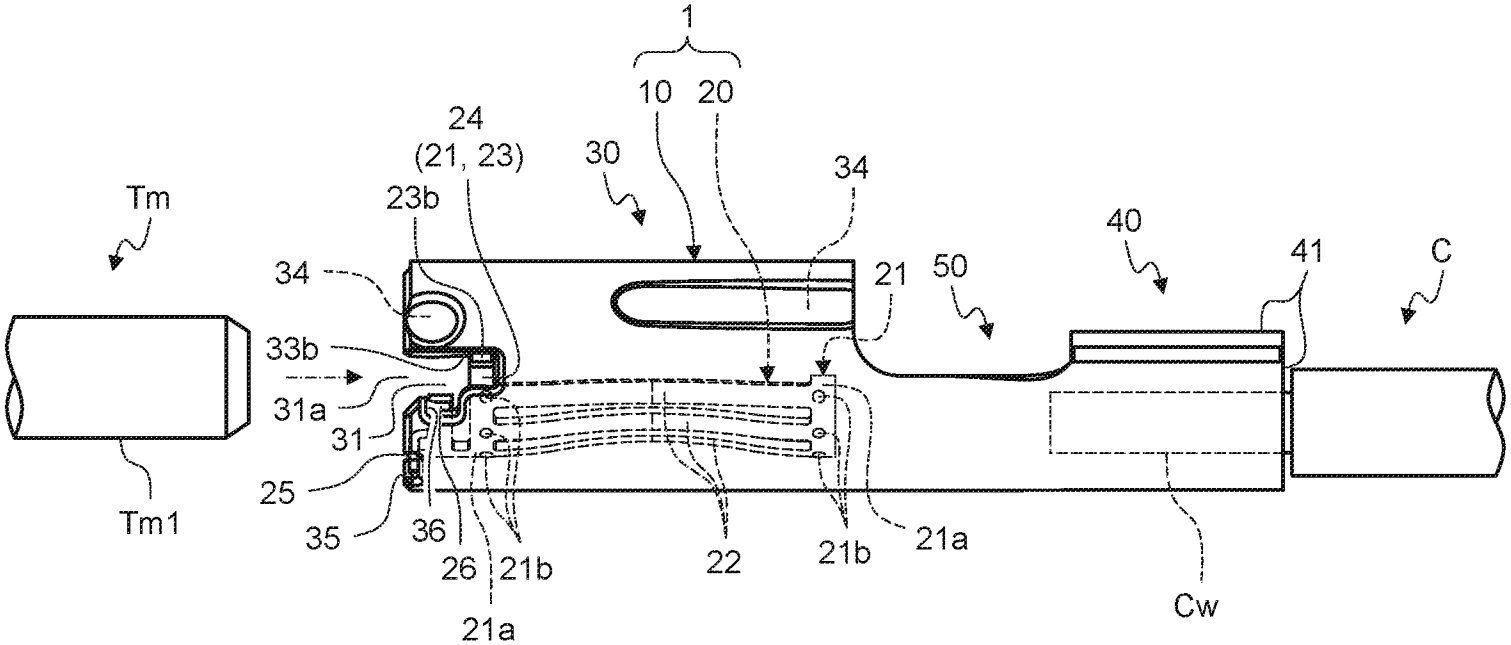
FIG. 2 is a side view of the connection terminal of the embodiment.

Reference numeral 1 in FIG. 1 to FIG. 4 indicates the connection terminal of the present embodiment. This connection terminal 1 is called a female terminal and establishes physical and electric connection with a counter male terminal Tm (FIG. 2). This connection terminal 1 includes a terminal main body 10 and a contact member 20 and is formed by assembling them.

The terminal main body 10 is made of a conductive material such as metal. This exemplary terminal main body 10 is formed by performing press working such as cutting and bending on a conductive metal plate as a base material. This terminal main body 10 has a female connector 30, a wire connector 40, and a coupler 50.

The female connector 30 is a part formed to be female in order for a male connector Tm1 of the male terminal Tm to be inserted in the female connector and is electrically connected to the male connector Tm1 by the insertion. The female connector 30 is formed in a tubular shape having an internal space 31 with a columnar shape in accordance with the male connector Tm1 formed in a columnar shape. The insertion and the removal of the male connector Tm1 into and from the internal space 31 are performed from an opening 31*a* at one end of the tubular body. In this example, the internal space 31 of the female connector 30 and the male connector Tm1 are formed in a cylindrical shape. The female connector 30 of this example, which is unconcerned about its appearance, is formed to have at least the internal space 31 with a cylindrical shape, and along its axis, the insertion and the removal of the male connector Tm1 are performed. In this example, a plate-shaped base material is bent to form the female connector 30 in a cylindrical shape, thereby forming the internal space 31 with a cylindrical shape therewithin.

The wire connector 40 is a part to which a conducting part Cw (FIG. 2) of a wire or an electrical wire C is electrically connected. The connection may be performed by any of crimping such as swaging, welding, and soldering, for example. In this example, a base material is bent to form the wire connector 40 with a U shape. The wire connector 40 has two barrel pieces 41 opposed to each other, and both barrel pieces 41 are wound around a core wire of the wire C as the conducting part Cw to be crimped on the conducting part Cw and are thereby connected to this conducting part Cw physically and electrically.

The coupler 50 is a part interposed between the female connector 30 and the wire connector 40 and couples them to each other.

The contact member 20 is formed along an inner circumferential face 32 (FIG. 4) of the female connector 30 of this terminal main body 10 and is accommodated into the internal space 31 from an opening 31*a* as an insertion port. This contact member 20, in its inserted state, is electrically connected to the female connector 30 and is electrically connected to the male connector Tm1 inserted into the internal space 31 from the opening 31*a* as an insertion port. This contact member 20 is made of a conductive material such as metal. This exemplary contact member 20 is formed by performing press working such as cutting and bending on a conductive metal plate as a base material.

This contact member 20 has a first contact 21 electrically connected to the female connector 30 and a second contact 22 electrically connected to the male connector Tm1 inserted into the internal space 31.

The first contact 21 is formed in an arcuate shape in a circumferential direction of the inner circumferential face 32 of the female connector 30 and is electrically connected to the inner circumferential face 32 of the female connector 30 on its arcuate outer circumferential face 21*a* (FIG. 5) side. This first contact 21 is brought into contact with the inner circumferential face 32 within a range of at least a half circumference in the circumferential direction. In this example, the first contact 21 and the inner circumferential face 32 are brought into contact with each other within the range of the half circumference thereof. This exemplary first contact 21 is formed with a plurality of spherical contacts 21*b* swelled outward in a radial direction within the range on the outer circumferential face 21*a*. The contacts 21*b* are arranged at substantially regular intervals in the circumferential direction. The first contact 21 is brought into contact with the inner circumferential face 32 of the female connector 30 via the contacts 21*b*.

The second contact 22 is arranged in the internal space 31 while being coupled to the first contact 21. This second contact 22 is pushed outward in the radial direction of the internal space 31 (toward the inner circumferential face 32) by the male connector Tm1 inserted into the internal space 31. This second contact 22 comes into contact with the male connector Tm1 at its pushed part (a pushed part) and is electrically connected to the male connector Tm1 with the pushed part as a contact.

This contact member 20 includes each of the first contact 21 and second contact 22 by at least one. The contact member 20 has at least two first contacts 21 arranged to be spaced apart from each other in the axial direction (an insertion/removal direction) of the female connector 30 and has a plurality of second contacts 22 as coupling parts that couple two adjacent first contacts 21 to each other, for example. The first contacts 21 are arranged so as to be concentric with the internal space 31 and are offset from each other in the axial direction. The second contacts 22 are formed so as to be bent outward in the radial direction in the radial direction when being pushed outward in the radial direction of the internal space 31 by the male connector Tm1 inserted into the internal space 31. In this example, the second contacts 22 are formed in an arcuate shape protruding inward in the radial direction between the two adjacent first contacts 21, and an inward apex in the radial direction of the protruding shape is the pushed part as the contact.

In this contact member 20, the contacts 21*b* of the first contacts 21 are desirably brought into contact with the inner circumferential face 32 of the female connector 30 before the male connector Tm1 is inserted into the internal space 31. In other words, the contact member 20, before the insertion, desirably prevents the floating of the first contacts 21 from the inner circumferential face 32 of the female connector 30 to inhibit the floating of the entire contact member 20 relative to the inner circumferential face 32.

Figure 3:
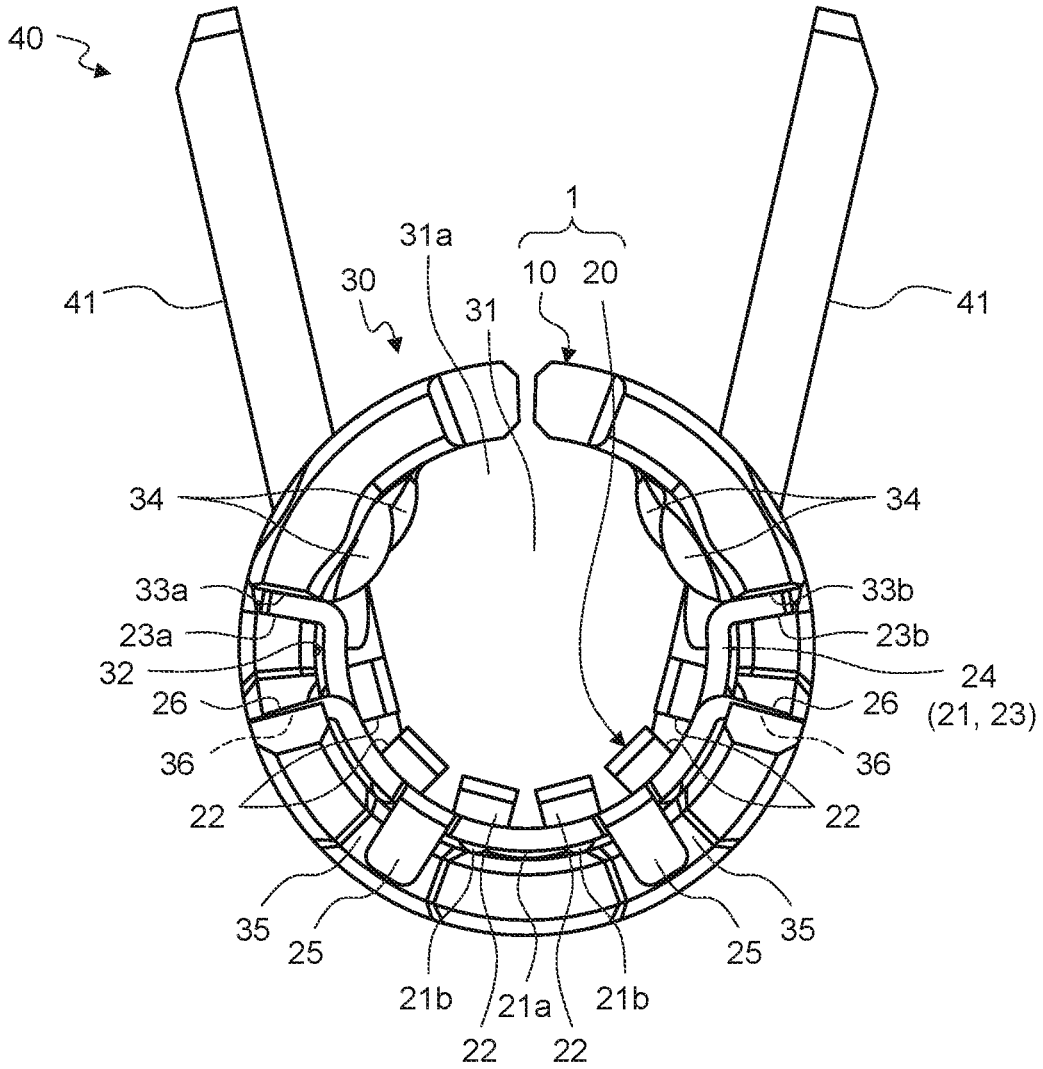
FIG. 3 is an elevational view of the connection terminal of the embodiment.

The connection terminal 1 of the present embodiment therefore provides a floating inhibiting structure that inhibits the floating of the contact member 20 relative to the inner circumferential face 32 of the female connector 30. The floating inhibiting structure includes a floating inhibiting part 23 described below, which is provided in the contact member 20 and first and second receiving parts 33*a* and 33*b* described below provided in the female connector 30 (FIG. 3).

The contact member 20 of the present embodiment includes the floating inhibiting part 23 that inhibits the floating of the first contacts 21 relative to the inner circumferential face 32 of the female connector 30. The floating inhibiting part 23 is a part that inhibits the floating of the first contacts 21 relative to the inner circumferential face 32 of the female connector 30 in relation to the first and second receiving parts 33*a* and 33*b* of the female connector 30, thereby inhibiting the floating of the contact member 20 relative to the inner circumferential face 32.

The floating inhibiting part 23 of the present embodiment is formed in an arcuate shape in the circumferential direction of the inner circumferential face 32 of the female connector 30 and is formed to generate a resilient force according to a change in the curvature of the arcuate shape. This floating inhibiting part 23 is formed so as to apply a pressing force responsive to the resilient force to the female connector 30 and to generate a force in a pressing direction toward the inner circumferential face 32 of the female connector 30 by input of a reaction force from the female connector 30 against the pressing force. This floating inhibiting part 23 inhibits the floating of the first contacts 21 relative to the inner circumferential face 32 of the female connector 30 using the force in the pressing direction. Consequently, to enable the force in the pressing direction to be transmitted to the first contacts 21, the floating inhibiting part 23 is arranged at a position that can transmit the force. The floating inhibiting part 23 may be directly or indirectly connected to the first contact 21 or integral with the first contact 21, for example.

This floating inhibiting part 23 has two force applying points (a first force applying point 23*a* and a second force applying point 23*b*) that apply its pressing force to the female connector 30 and to which the reaction force thereof is input. The first force applying point 23*a* is provided at one end in the circumferential direction of the floating inhibiting part 23. The second force applying point 23*b* is provided at the other end in the circumferential direction of the floating inhibiting part 23.

The female connector 30 has a first receiving part 33*a* having a relationship to the first force applying point 23*a* and a second receiving part 33*b* having a relationship to the second force applying point 23*b*. The first receiving part 33*a* is a part that locks the first force applying point 23*a* and receives the pressing force (responsive to the resilient force according to the change in the curvature of the floating inhibiting part 23) from the first force applying point 23*a* and applies the reaction force against the pressing force to the first force applying point 23*a*. The second receiving part 33*b* is a part that locks the second force applying point 23*b* and receives the pressing force (responsive to the resilient force according to the change in the curvature of the floating inhibiting part 23) from the second force applying point 23*b* and applies the reaction force against the pressing force to the second force applying point 23*b*.

This floating inhibiting part 23 generates a force in the pressing direction toward the inner circumferential face 32 of the female connector 30 by the reaction forces as described above. With this force, the connection terminal 1 of the present embodiment can inhibit the floating of the first contacts 21 relative to the inner circumferential face 32 of the female connector 30 and can also inhibit the floating of the second contacts 22 relative to the inner circumferential face 32 of the female connector 30 accordingly, and as a consequence, the floating of the contact member 20 relative to the inner circumferential face 32 of the female connector 30 can be inhibited.

Consequently, when the male connector Tm1 is inserted into the internal space 31 of the female connector 30, this connection terminal 1 can avoid the collision of the male connector Tm1 with the contact member 20 and enables a pushing operation on the second contacts 22 outward in the radial direction by this male connector Tm1. Consequently, this connection terminal 1 not only enables respective pieces of electric connection between the female connector 30 and the contact member 20 and between the male connector Tm1 and the contact member 20 but also can improve the durability of the contact member 20. In addition, this connection terminal 1 can improve not only its own durability but also the durability of the male connector Tm1.

Further, this connection terminal 1 can inhibit the floating of the contact member 20 and can inhibit the contact member 20 from dropping from the female connector 30 even without covering the female connector 30 with a lid member or the like. Consequently, this connection terminal 1 can improve insertion workability for the male connector Tm1.

As described above, the connection terminal 1 of the present embodiment can achieve the advantageous effect of inhibiting the floating of the contact member 20 and advantageous effects associated therewith by the minimum required components, or the terminal main body 10 and the contact member 20. Consequently, this connection terminal 1 can achieve its own improvement in productivity and a reduction in cost and can achieve improvement in productivity and a reduction in cost also in relation to the male terminal Tm to be inserted.

Still further, in this connection terminal 1, the first force applying point 23*a* and the second force applying point 23*b* of the floating inhibiting part 23 apply respective pressing forces in circumferentially opposite directions, and the first force applying point 23*a*, the second force applying point 23*b*, the first receiving part 33*a*, and the second receiving part 33*b* can inhibit the positional deviation of the contact member 20 in the circumferential direction relative to the female connector 30.

The female connector 30 of the present embodiment includes a plurality of contacts 34 provided on a wall face opposed to the contact member 20 inside the female connector and at a place where the contact member 20 is not arranged (FIG. 3). The contacts 34 are formed as swelled parts swelled inward in the radial direction in the internal space 31. The male connector Tm1 inserted into the internal space 31 is held between the contact member 20 and the contacts 34, and the contact member 20 and the contacts 34 ensure a holding force in the internal space 31. Consequently, this male connector Tm1 establishes the electric connection with the female connector 30 indirectly via the contact member 20 and directly via the contacts 34.

Figure 4:
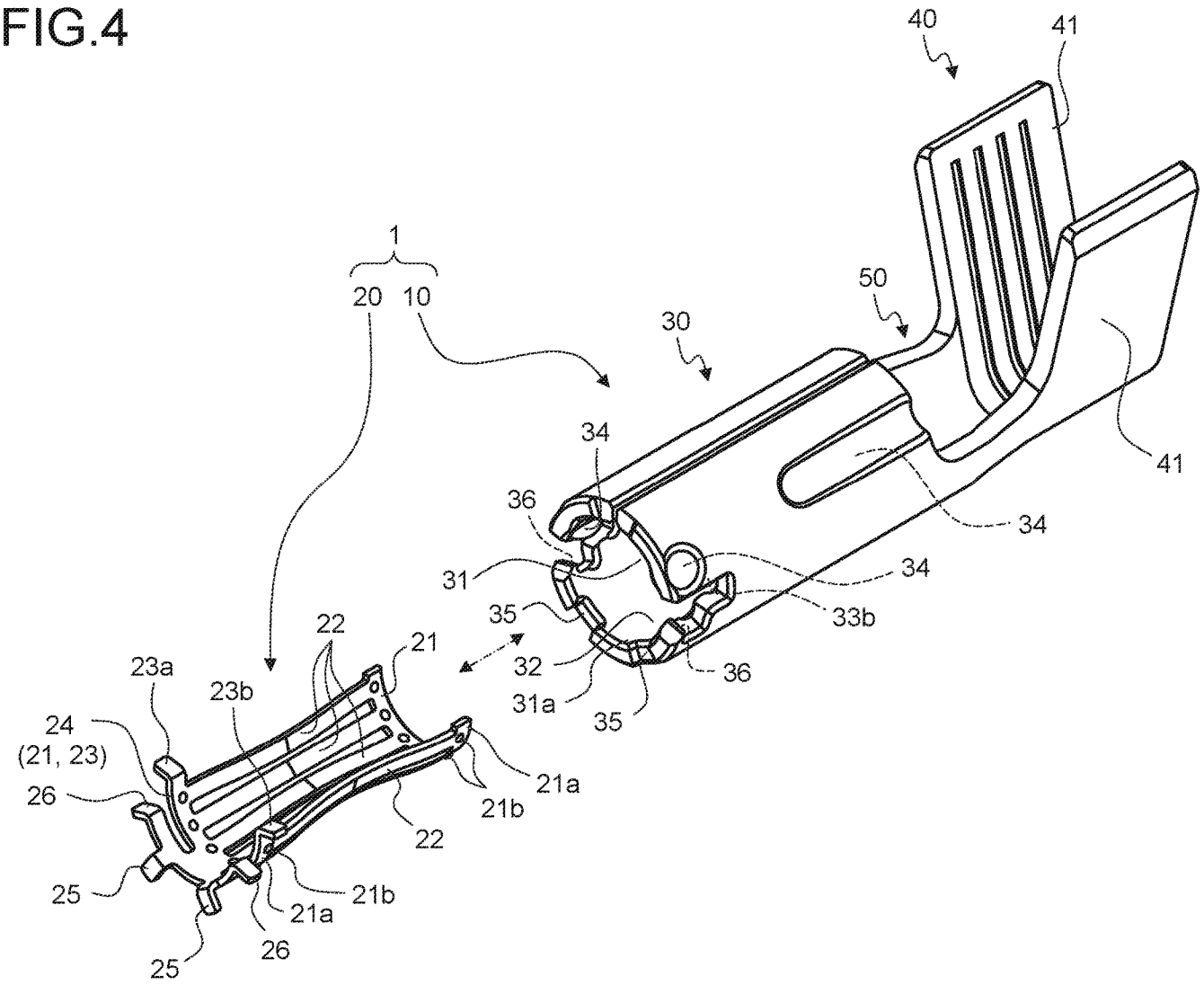
FIG. 4 is an exploded perspective view of the connection terminal of the embodiment.
Figure 5:
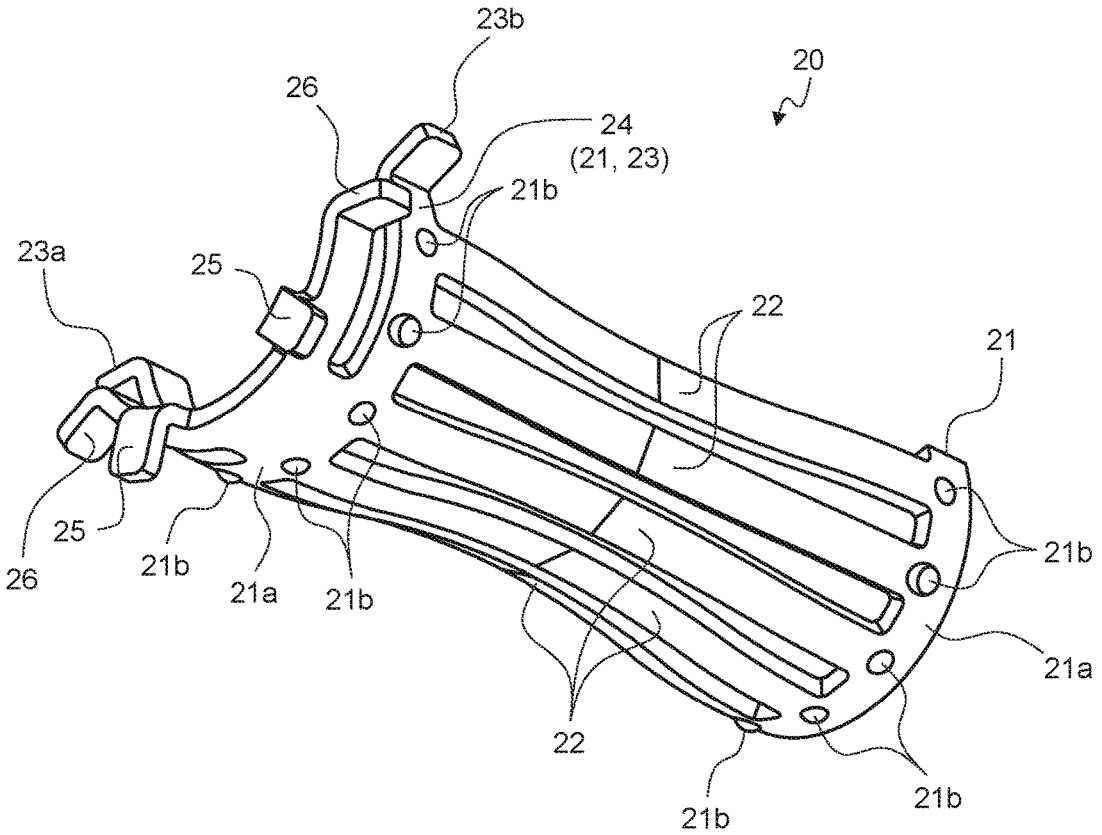
FIG. 5 is a perspective view of a contact member of the embodiment.

This connection terminal 1 is provided with a positional deviation inhibiting structure that inhibits the positional deviation of the contact member 20 in the axial direction relative to the female connector 30 at the time of the insertion and the removal of the male connector Tm1. Consequently, the contact member 20 has each of a first locked part 25 and a second locked part 26 by at least one, that are configured to protrude outward in the radial direction (FIG. 3 and FIG. 4). The female connector 30 has an insertion direction locking part 35 that locks the first locked part 25 in the insertion direction of the male connector Tm1 relative to the internal space 31 and a removal direction locking part 36 that locks the second locked part 26 in the removal direction of the male connector Tm1 relative to the internal space 31. In other words, in this connection terminal 1, the positional deviation inhibiting structure of the contact member 20, when the male terminal is inserted, includes the first locked part 25 and the insertion direction locking part 35, and the positional deviation inhibiting structure of the contact member 20, when the male terminal is removed, includes the second locked part 26 and the removal direction locking part 36.

In the positional deviation inhibiting structure of the contact member 20 when the male terminal is inserted, when the contact member 20 has been inserted into the internal space 31 from the opening 31*a*, the first locked part 25 is locked by the insertion direction locking part 35, and therefore the contact member 20 can be accommodated at a predetermined position of the internal space 31 and locked to the position. In addition, even if the contact member 20 attempts to move relative to the female connector 30 by a frictional force with the male connector Tm1 or the like when the male connector Tm1 is inserted into the internal space 31, this positional deviation inhibiting structure can lock the contact member 20 to the predetermined position of the internal space 31 by a locking action between the first locked part 25 and the insertion direction locking part 35. Consequently, this positional deviation inhibiting structure can inhibit the positional deviation of the contact member 20 in the axial direction relative to the internal space 31 and can thereby maintain the electric connection between the female connector 30 and the male connector Tm1.

In the positional deviation inhibiting structure of the contact member 20 when the male terminal is removed, even if the contact member 20 attempts to move relative to the female connector 30 by a frictional force with the male connector Tm1 or the like when the male connector Tm1 is removed from the internal space 31 toward the opening 31*a*, the second locked part 26 is locked by the removal direction locking part 36, and the contact member 20 can be locked to the predetermined position of the internal space 31. Consequently, this positional deviation inhibiting structure can inhibit the positional deviation of the contact member 20 in the axial direction relative to the internal space 31 and can thereby electrically connect the female connector 30 and the male connector Tm1 when the male connector Tm1 is again inserted.

Thus, the connection terminal 1 of the present embodiment can inhibit the contact member 20 from dropping from the female connector 30 even without covering the female connector 30 with a lid member or the like owing to these positional deviation inhibiting structures with the floating inhibiting structure of the contact member 20.

The following describes specific modes of the contact member 20 and the female connector 30 of the connection terminal 1.

The contact member 20 of the present embodiment is arranged on a bottom side of the internal space 31 (in other words, a side where a part connected to a bottom coupling the barrel pieces 41 to each other is present). However, this arrangement of the contact member 20 in the circumferential direction of the internal space 31 is not necessarily limited to this exemplary mode and may be at any position in the circumferential direction. This contact member 20 includes two first contacts 21 and six second contacts 22 coupling them to each other. One of the first contacts 21 is arranged on the opening 31*a* side, whereas the other thereof is arranged on the coupler 50 side in the internal space 31. The second contacts 22 are arranged at substantially regular intervals in the circumferential direction of the first contacts 21.

In this contact member 20, the first contact 21 on the opening 31*a* side and the floating inhibiting part 23 are provided as one arcuate body 24 obtained by integrating them with each other. Consequently, the arcuate body 24 is provided with the contacts 21*b* of the first contact 21 on the outer circumferential face 21*a* and is provided with the first and second force applying parts 23*a* and 23*b* of the floating inhibiting part 23 at both ends in the circumferential direction thereof. The first force applying part 23*a* is formed as a piece configured to protrude outward in the radial direction from one end in the circumferential direction of the arcuate body 24. The second force applying part 23*b* is formed as a piece configured to protrude outward in the radial direction from the other end in the circumferential direction of the arcuate body 24.

This contact member 20 appropriately changes the curvature of its respective positions in the axial direction (a direction along an insertion direction to the internal space 31) by making it narrower or the like and is inserted into the internal space 31 with the respective positions made smaller. However, when becoming a cylindrical shape in the internal space of a female connector as in a conventional contact member, this contact member 20 involves a large amount of change in the curvature during its insertion, and durability may degrade. Further, in such a contact member becoming the cylindrical shape, the amount of change in the curvature of the respective positions in the axial direction is large, and work that inserts the contact member into the internal space of the female connector may be difficult. Even when, along with the bending of the female connector into a cylindrical shape, the contact member is wrapped thereinside in place of the work for inserting it, the contact member is required to be arranged on the base material of the female connector while being made narrower in a cylindrical shape. Consequently, the conventional connection terminal has room for improvement in terms of durability and productivity.

This contact member 20 therefore forms its external shape along a part in the circumferential direction of the inner circumferential face 32 of the female connector 30. In this contact member 20, the arcuate body 24 is formed so as to have a central angle with respect to an arc, which is larger than 180 degrees, whereas the first contact 21 on the coupler 50 side is formed so as to have a central angle of substantially 180 degrees with respect to an arc. A size of the arc of the arcuate body 24 sets its central angle to the extent of not being an annular ring. Consequently, in this contact member 20, its physical size on the coupler 50 side of the arcuate body 24 has a central angle of substantially 180 degrees with respect to an arc and is not cylindrically shaped. Consequently, in this connection terminal 1, the contact member 20 can be inserted into the internal space 31 with the amount of change in curvature reduced compared with the conventional cylindrical contact member. Consequently, the contact member 20 can stop the change in curvature during its insertion within the range of an elastic range and can thus improve its durability. Further, this connection terminal 1 can also improve its productivity by this contact member 20.

Specifically, in this connection terminal 1, when the contact member 20 is accommodated into the internal space 31, with the curvature of the first contact 21 on the coupler 50 side made larger to make it narrower, this first contact 21 is inserted from the opening 31*a*, and then with the curvature of the arcuate body 24 having the function of the floating inhibiting part 23 made smaller to generate a resilient force, this arcuate body 24 is inserted from the opening 31*a*, for example. Consequently, after being accommodated into the internal space 31, the arcuate body 24 increases in curvature to return to its original form and applies respective pressing forces in the circumferential direction to the first receiving part 33*a* and the second receiving part 33*b* from the first force applying point 23*a* and the second force applying point 23*b*, respectively. When viewed from the viewpoint of FIG. 3, this arcuate body 24 applies a clockwise pressing force from the first force applying point 23*a* and applies a counterclockwise pressing force from the second force applying point 23*b*. In other words, this arcuate body 24 applies respective pressing forces in circumferentially opposite directions to the first receiving part 33*a* and the second receiving part 33*b* from the first force applying point 23*a* and the second force applying point 23*b*, respectively.

The female connector 30 provides the first receiving part 33*a* and the second receiving part 33*b* at positions that correspond to the respective positions of the first force applying point 23*a* and the second force applying point 23*b* and can receive the pressing forces. The first receiving part 33*a* and the second receiving part 33*b* use respective one side walls in the circumferential direction of notches cut out in the axial direction from the end on the opening 31*a* side of the female connector 30. In this example, when viewed from the viewpoint of FIG. 3, a side wall present on a clockwise side out of two side walls in the circumferential direction of the notch arranged corresponding to the first force applying point 23*a* is used as the first receiving part 33*a*, whereas a side wall present on a counterclockwise side out of two side walls in the circumferential direction of the notch arranged corresponding to the second force applying point 23*b* is used as the second receiving part 33*b*. Consequently, the first force applying point 23*a* and the first receiving part 33*a* are formed so as to house the first force applying point 23*a* in the notch forming the first receiving part 33*a*. The second force applying point 23*b* and the second receiving part 33*b* are formed so as to house the second force applying point 23*b* in the notch forming the second receiving part 33*b*.

The reaction force against the pressing force acts on the first force applying point 23*a* of the arcuate body 24 from the first receiving part 33*a*, whereas the reaction force against the pressing force acts on the second force applying point 23*b* from the second receiving part 33*b*. In other words, the first receiving part 33*a* and the second receiving part 33*b* apply respective reaction forces in circumferentially opposite directions to the first force applying point 23*a* and the second force applying point 23*b*, respectively. With these reaction forces, a force in a pressing direction toward the inner circumferential face 32 of the female connector 30 is generated in this arcuate body 24. Consequently, the contact member 20 inhibits the floating of the arcuate body 24 (the first contact 21 on the opening 31*a* side and the floating inhibiting part 23) relative to the inner circumferential face 32 and also inhibits the floating of the second contacts 22 and the first contact 21 on the coupler 50 side relative to the inner circumferential face 32 accordingly. Consequently, this connection terminal 1 can inhibit the floating of the contact member 20 relative to the inner circumferential face 32.

The exemplary female connector 30 provides four contacts 34 at places where the contact member 20 is not arranged on the inner circumferential face 32. Specifically, the female connector 30 includes two contacts 34 spaced apart from each other in the circumferential direction at the end on the opening 31*a* side and includes two contacts 34 spaced apart from each other in the circumferential direction at the end on the coupler 50 side (FIG. 1 to FIG. 4). The contacts 34 on the opening 31*a* side are spherical swelled parts swelled inward in the radial direction from the inner circumferential face 32. The contacts 34 on the coupler 50 side are arcuate swelled parts swelled inward in the radial direction from the inner circumferential face 32 and are extended in the axial direction.

Further, this example configures the positional deviation inhibiting structure of the contact member 20 when the male terminal is inserted and the positional deviation inhibiting structure of the contact member 20 when the male terminal is removed as follows.

In the positional deviation inhibiting structure of the contact member 20 when the male terminal is inserted, the first locked part 25 is provided at an end on the arcuate body 24 side of the contact member 20. This exemplary first locked part 25 is a piece provided on the opening 31*a* side of the arcuate body 24 in the contact member 20 accommodated into the internal space 31, and two first locked parts 25 are arranged to be spaced apart from each other in the circumferential direction. The two insertion direction locking parts 35 that lock these first locked parts 25 are arranged to be spaced apart from each other in the circumferential direction at an end on the opening 31*a* side of the female connector 30 at positions that correspond to the respective positions of the first locked parts 25. These exemplary insertion direction locking parts 35 use respective bottom walls in the axial direction of notches cut out in the axial direction from the end on the opening 31*a* side of the female connector 30. Consequently, the first locked parts 25 and the insertion direction locking parts 35 are formed so as to house the first locked parts 25 in the respective notches. This positional deviation inhibiting structure of the contact member 20 when the male terminal is inserted can inhibit the positional deviation of the contact member 20 in the axial direction relative to the female connector 30 as described above by this configuration. Further, this positional deviation inhibiting structure can also inhibit the positional deviation of the contact member 20 in the circumferential direction relative to the female connector 30 by narrowing respective gaps between respective side walls in the circumferential direction of the respective notches and the respective first locked parts 25.

In the positional deviation inhibiting structure of the contact member 20 when the male connector is removed, the second locked part 26 is provided at the end on the arcuate body 24 side of the contact member 20. This exemplary second locked part 26 is a piece provided on the opening 31*a* side of the arcuate body 24 in the contact member 20 accommodated into the internal space 31, and two second locked parts 26 are arranged to be spaced apart from each other in the circumferential direction. The two removal direction locking parts 36 that lock these second locked parts 26 are arranged to be spaced apart from each other in the circumferential direction at the end on the opening 31*a* side of the female connector 30 at positions that correspond to the respective positions of the second locked parts 26. These exemplary removal direction locking parts 36 use respective side walls on the opening 31*a* side in the axial direction of notches obtained by further cutting out part of the respective other side walls of the respective notches related to the first receiving part 33*a* and the second receiving part 33*b* in the circumferential direction. Consequently, the second locked parts 26 and the removal direction locking parts 36 are formed so as to house the second locked parts 26 in the respective notches. This positional deviation inhibiting structure of the contact member 20 when the male connector is removed can inhibit the positional deviation of the contact member 20 in the axial direction relative to the female connector 30 as described above by this configuration. Further, this positional deviation inhibiting structure can also inhibit the positional deviation of the contact member 20 in the circumferential direction relative to the female connector 30 by narrowing respective gaps between respective bottom walls in the circumferential direction of the respective notches and the respective second locked parts 26.

First Modification

The following describes a modification of the specific modes of the contact member 20 and the female connector 30 with reference to FIG. 6 to FIG. 10. A connection terminal related to this modification will be referred to as a connection terminal 2 for convenience.

Figure 6:
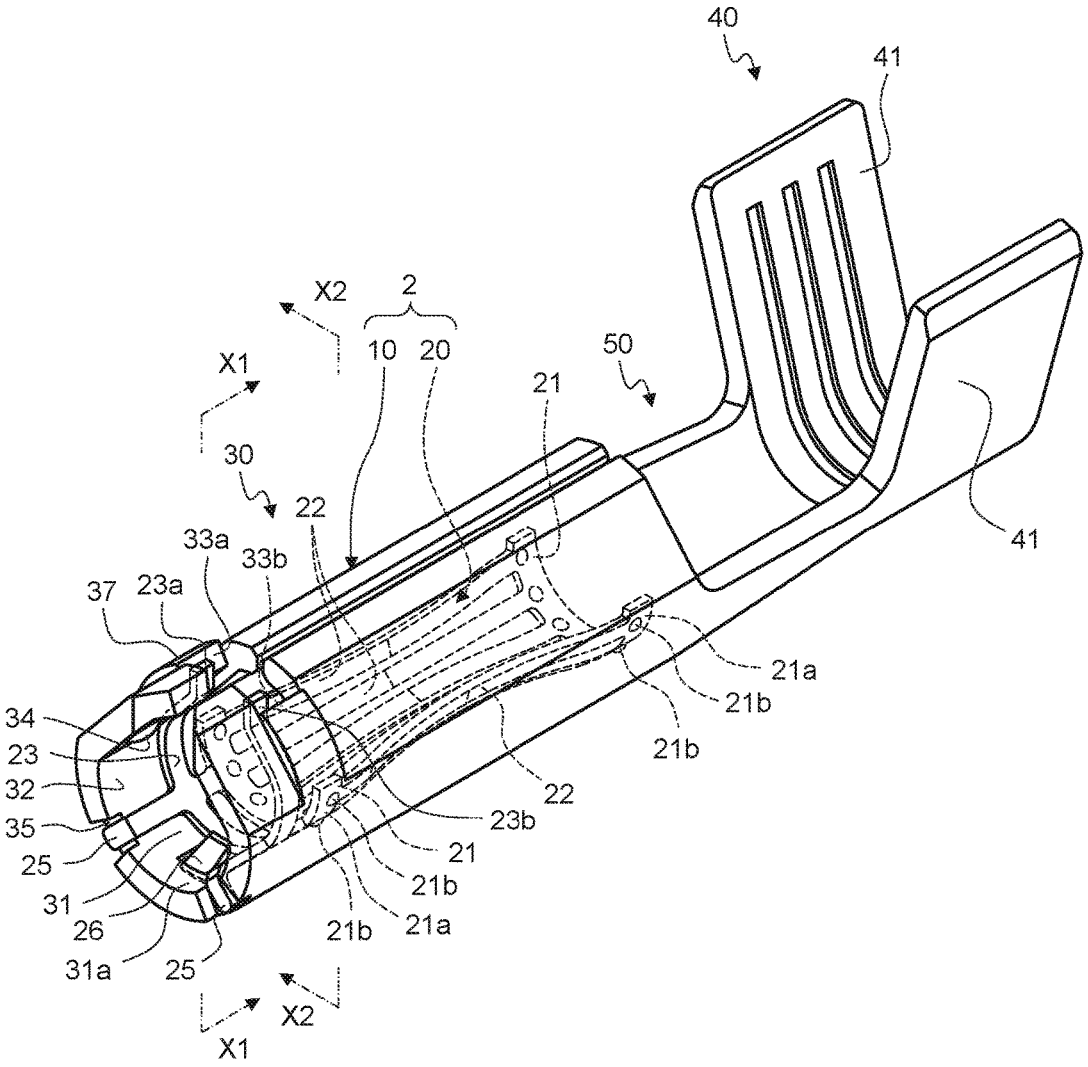
FIG. 6 is a perspective view of a connection terminal of a first modification.
Figure 7:
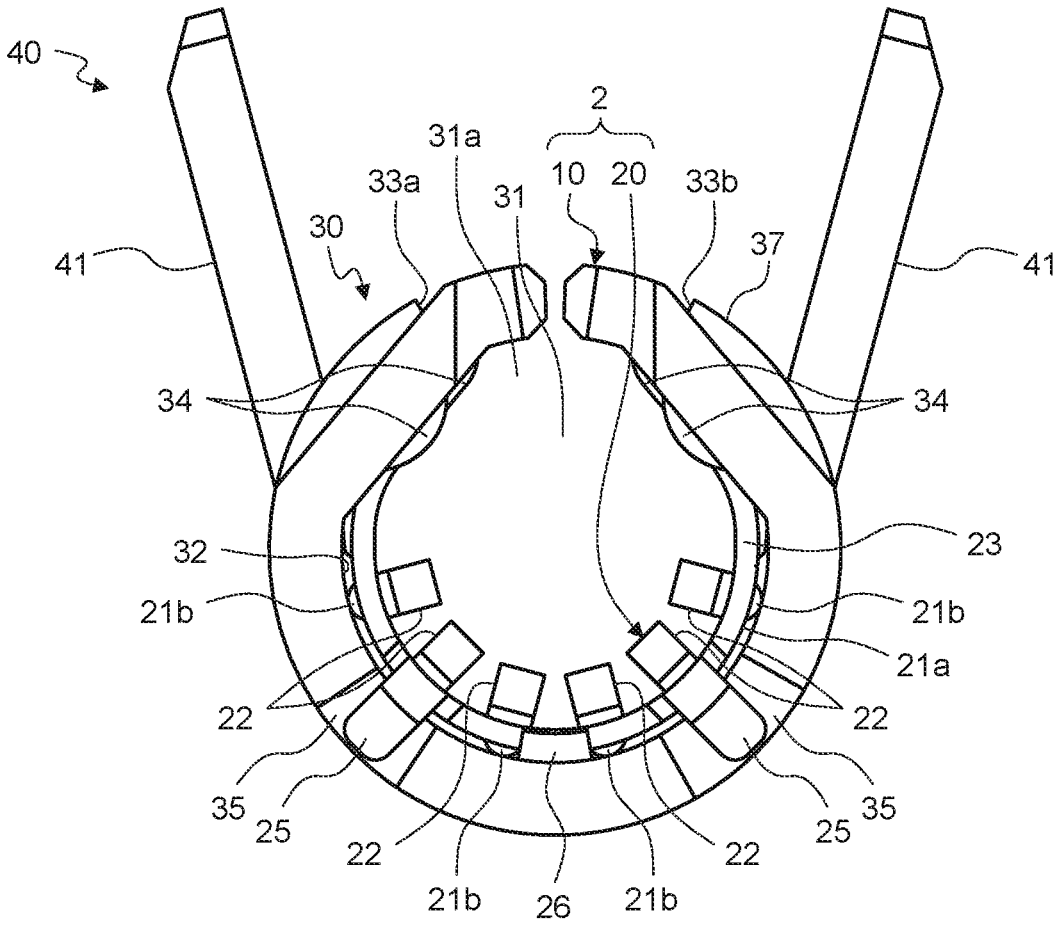
FIG. 7 is an elevational view of the connection terminal of the first modification.
Figure 8:
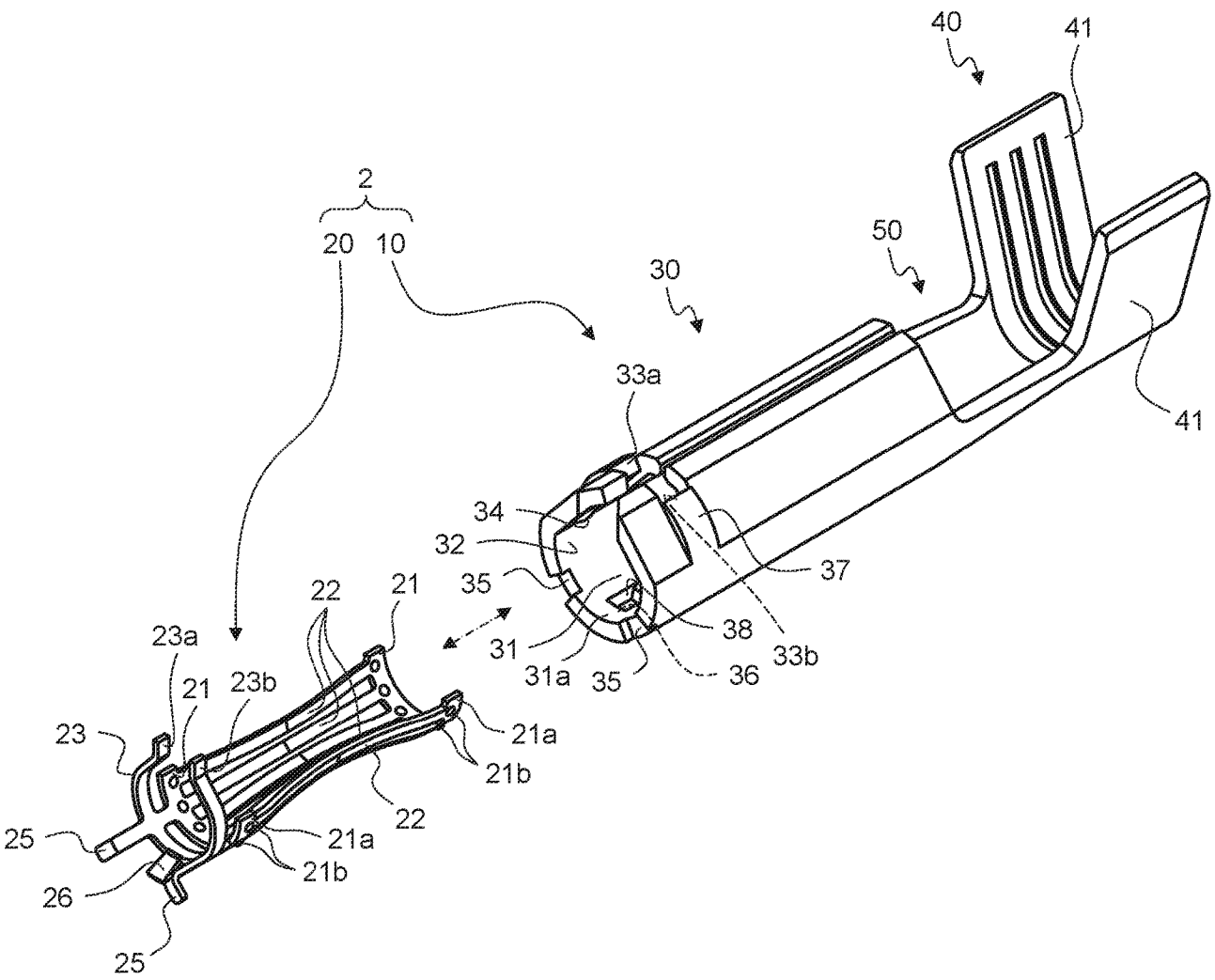
FIG. 8 is an exploded perspective view of the connection terminal of the first modification.
Figure 9:
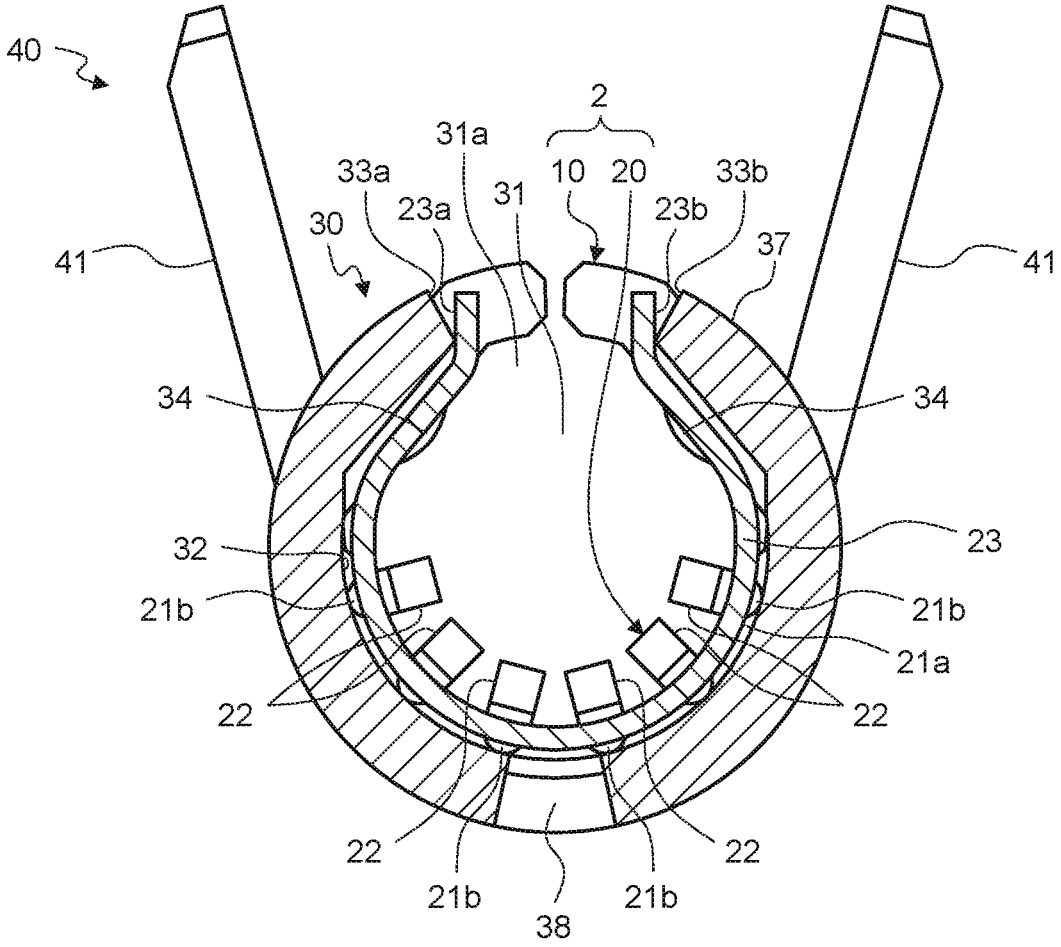
FIG. 9 is an X1-X1 line sectional view of FIG. 6.
Figure 10:
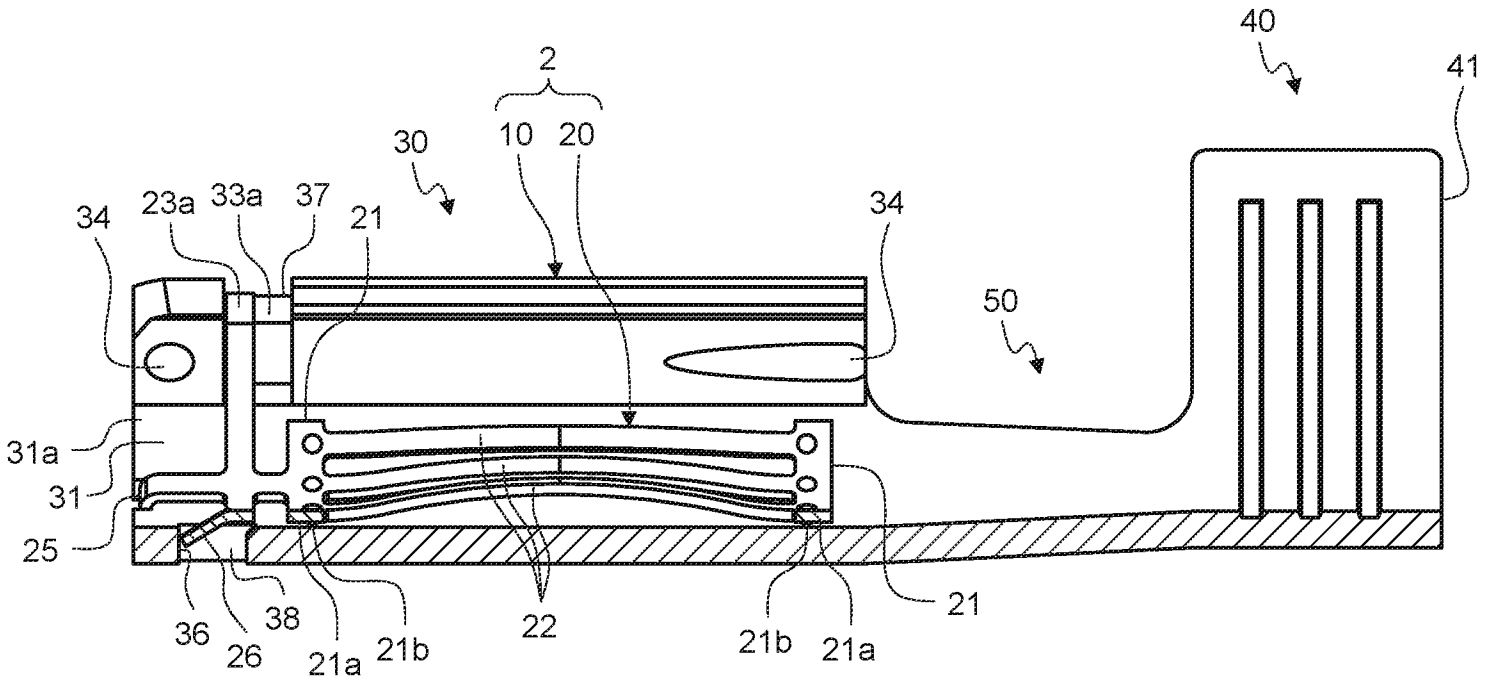
FIG. 10 is an X2-X2 line sectional view of FIG. 6.

The female connector 30 of the present modification has the substantially cylindrical internal space 31 in which the cylindrical male connector Tm1 is accommodated and is formed in a tubular shape. This female connector 30 includes at least the inner circumferential face 32 including an arc the central angle of which is larger than 180 degrees, and the contact member 20 of the present modification including the contacts 21*b* against the inner circumferential face 32 is arranged therewithin (FIG. 6 to FIG. 8). This female connector 30 provides a plurality of contacts 34 on a wall face thereinside opposed to the inner circumferential face 32 (FIG. 7 and FIG. 10). In this example, four contacts 34 similar to the specific example of the embodiment are provided, and the male connector Tm1 inserted into the internal space 31 is held between the contact member 20 and the contacts 34.

The contact member 20 of the present modification includes two first contacts 21 and six second contacts 22 similar to the contact member 20 of the specific example of the embodiment. However, the contact member 20 of the present modification includes the floating inhibiting part 23 on the opening 31*a* side when being accommodated into the internal space 31 and on the opening 31*a* side of the first contact 21 on the opening 31*a* side (FIG. 8).

In this contact member 20, each of the first contacts 21 is formed so as to have a central angle of substantially 180 degrees with respect to an arc, whereas the floating inhibiting part 23 is formed so as to have a central angle which is larger than 180 degrees with respect to an arc. The size of the arc of the floating inhibiting part 23 sets its central angle to the extent of not being an annular ring. In this example, the floating inhibiting part 23 is formed so as to be Landolt ring-shaped. Consequently, in this contact member 20, its physical size on the coupler 50 side of the floating inhibiting part 23 has a central angle of substantially 180 degrees with respect to an arc and is not cylindrically shaped. Consequently, in this connection terminal 2, the contact member 20 can be inserted into the internal space 31 with the amount of change in curvature reduced similarly to the connection terminal 1 of the specific example of the embodiment. Consequently, this connection terminal 2 can improve its durability and productivity.

Specifically, in this connection terminal 2, when the contact member 20 is accommodated into the internal space 31, with the curvature of the first contact 21 on the coupler 50 side made larger to make it narrower, this first contact 21 is inserted from the opening 31*a*, and then with the curvature of the first contact 21 on the opening 31*a* side made larger to make it narrower, this first contact 21 is inserted from the opening 31*a*, for example. In this connection terminal 2, with the curvature of the floating inhibiting part 23 made larger to generate a resilient force, this floating inhibiting part 23 is inserted from the opening 31*a*. Consequently, after being accommodated into the internal space 31, the floating inhibiting part 23 decreases in curvature to return to its original form and applies respective pressing forces in the circumferential direction to the first receiving part 33*a* and the second receiving part 33*b* from the first force applying point 23*a* and the second force applying point 23*b*, respectively. When viewed from the viewpoint of FIG. 9, the floating inhibiting part 23 of the present modification applies a counterclockwise pressing force from the first force applying point 23*a* and applies a clockwise pressing force from the second force applying point 23*b*. In other words, this floating inhibiting part 23 applies respective pressing forces in circumferentially opposite directions to the first receiving part 33*a* and the second receiving part 33*b* from the first force applying point 23*a* and the second force applying point 23*b*, respectively.

The female connector 30 provides the first receiving part 33*a* and the second receiving part 33*b* at positions that correspond to the respective positions of the first force applying point 23*a* and the second force applying point 23*b* and can receive the pressing forces. The female connector 30 of the present modification is provided with a Landolt ring-shaped part 37 formed in a Landolt ring shape inside an end face on the opening 31*a* side in the axial direction. The first receiving part 33*a* and the second receiving part 33*b* use respective side walls of a notch of the Landolt ring-shaped part 37. In this example, when viewed from the viewpoint of FIG. 9, a side wall present on a counterclockwise side out of the side walls is used as the first receiving part 33*a*, whereas a side wall present on a clockwise side is used as the second receiving part 33*b*. Consequently, the first force applying point 23*a*, the second force applying point 23*b*, the first receiving part 33*a*, and the second receiving part 33*b* are formed so as to house the first force applying point 23*a* and the second force applying point 23*b* in the notch of the Landolt ring-shaped part 37.

The reaction force against the pressing force acts on the first force applying point 23*a* of the floating inhibiting part 23 from the first receiving part 33*a*, whereas the reaction force against the pressing force acts on the second force applying point 23*b* from the second receiving part 33*b*. In other words, the first receiving part 33*a* and the second receiving part 33*b* apply respective reaction forces in circumferentially opposite directions to the first force applying point 23*a* and the second force applying point 23*b*, respectively. With these reaction forces, a force in a pressing direction toward the inner circumferential face 32 of the female connector 30 is generated in this floating inhibiting part 23. Consequently, the contact member 20 inhibits the floating of the floating inhibiting part 23 relative to the inner circumferential face 32 and also inhibits the floating of the first contact 21 on the opening 31*a* side connected to this floating inhibiting part 23 relative to the inner circumferential face 32 accordingly. Consequently, this contact member 20 also inhibits the floating of the second contacts 22 and the first contact 21 on the coupler 50 side relative to the inner circumferential face 32. Consequently, this connection terminal 2 can inhibit the floating of the contact member 20 relative to the inner circumferential face 32.

The connection terminal 2 of the present modification includes the positional deviation inhibiting structure of the contact member 20 when the male terminal is inserted and the positional deviation inhibiting structure of the contact member 20 when the male terminal is removed described below. The positional deviation inhibiting structure of the contact member 20 when the male terminal is inserted is configured similarly to that of the connection terminal 1 of the specific example of the embodiment and includes two first locked parts 25 of the contact member 20 and two insertion direction locking parts 35 of the female connector 30. The positional deviation inhibiting structure of the contact member 20 when the male terminal is removed is configured as follows by the second locked part 26 provided in the contact member 20 and the removal direction locking part 36 provided in the female connector 30.

The second locked part 26 of the present modification is a piece configured to protrude outward in the radial direction from the floating inhibiting part 23 and toward the opening 31*a* when being accommodated into the internal space 31. The female connector 30 of the present modification is formed with a through hole 38 that causes the inside and the outside to communicate with each other at the end on the opening 31*a* side (FIG. 8). In this example, a side wall on the opening 31*a* side of the through hole 38 is used as the removal direction locking part 36. Consequently, the second locked part 26 and the removal direction locking part 36 are formed so as to insert the second locked part 26 into the through hole 38. This positional deviation inhibiting structure of the contact member 20 when the male terminal is removed can inhibit the positional deviation of the contact member 20 in the axial direction relative to the female connector 30 as described above by this configuration. Further, this positional deviation inhibiting structure can also inhibit the positional deviation of the contact member 20 in the circumferential direction relative to the female connector 30 by narrowing respective gaps between respective side walls in the circumferential direction of the through hole 38 and the second locked part 26.

Second Modification

The following describes another modification of the specific modes of the contact member 20 and the female connector 30 with reference to FIG. 11 to FIG. 14. A connection terminal related to this modification will be referred to as a connection terminal 3 for convenience.

Figure 11:
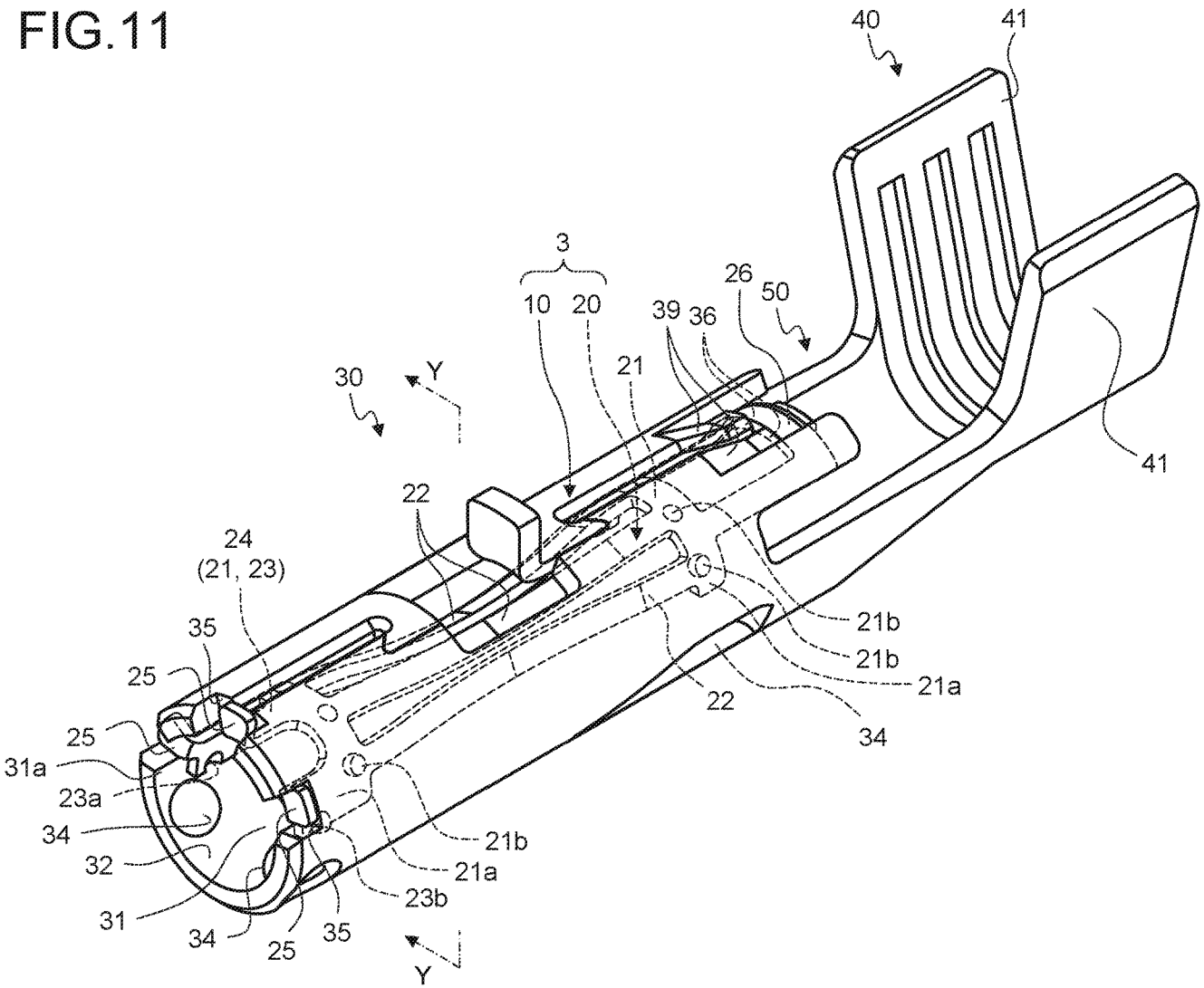
FIG. 11 is a perspective view of a connection terminal of a second modification.
Figure 12:
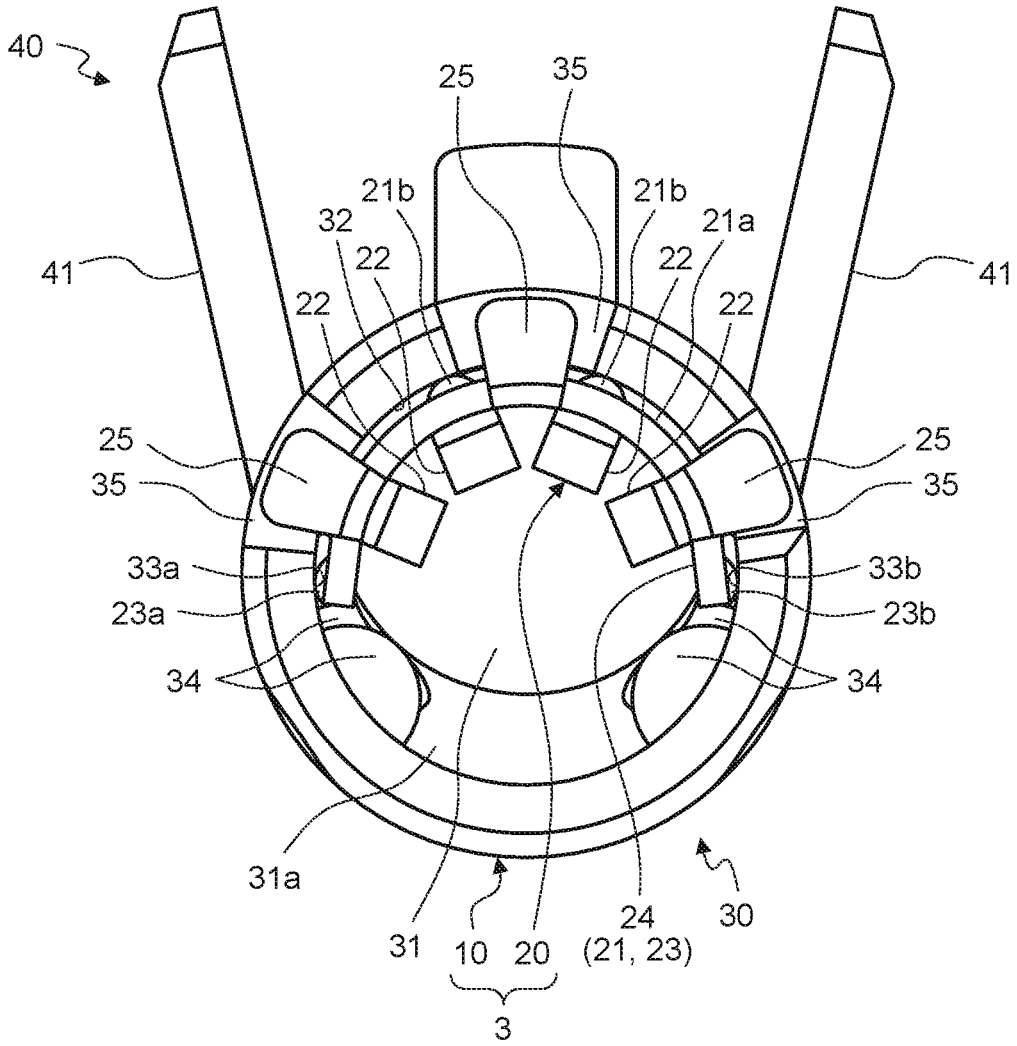
FIG. 12 is an elevational view of the connection terminal of the second modification.
Figure 13:
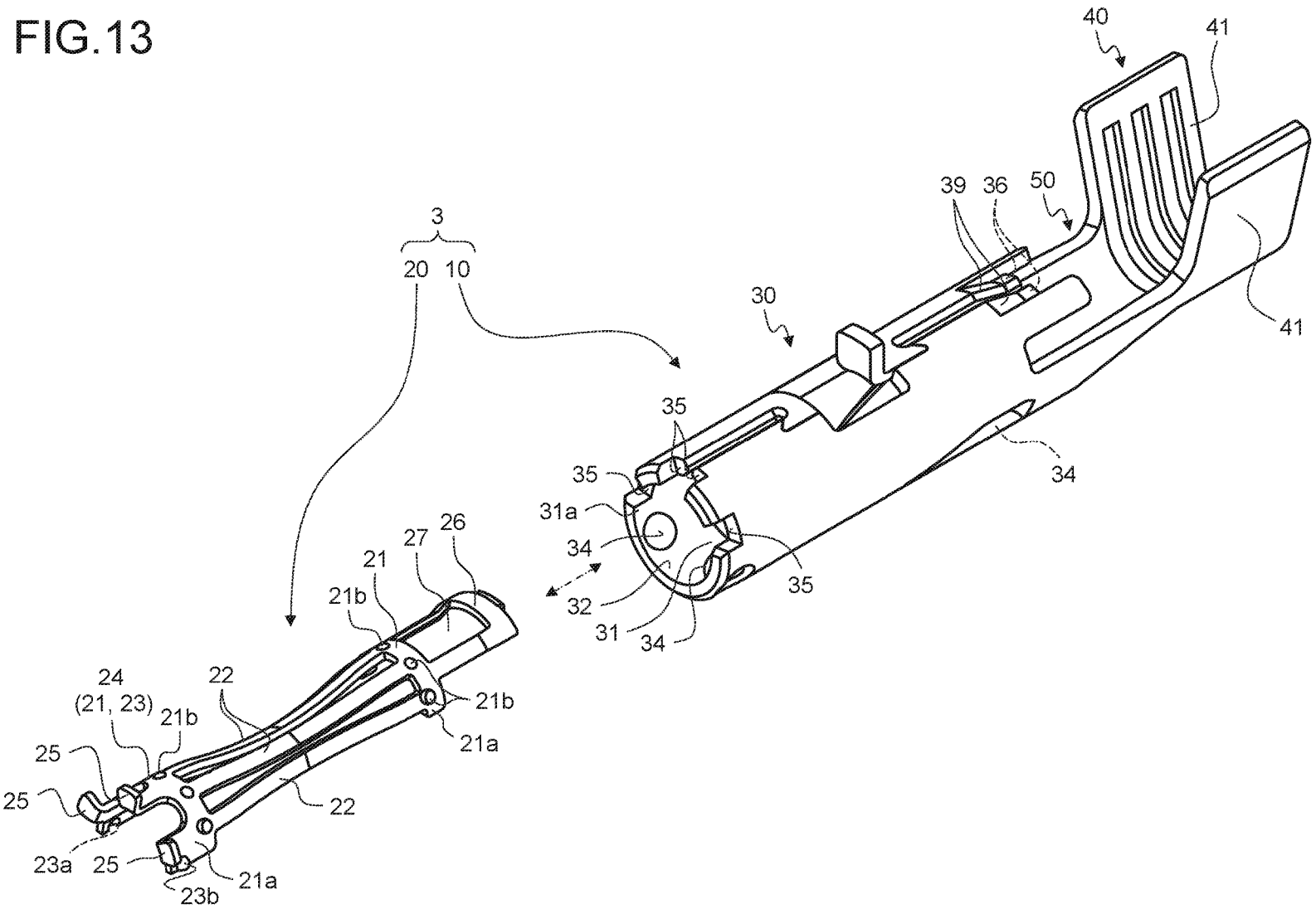
FIG. 13 is an exploded perspective view of the connection terminal of the second modification.
Figure 14:
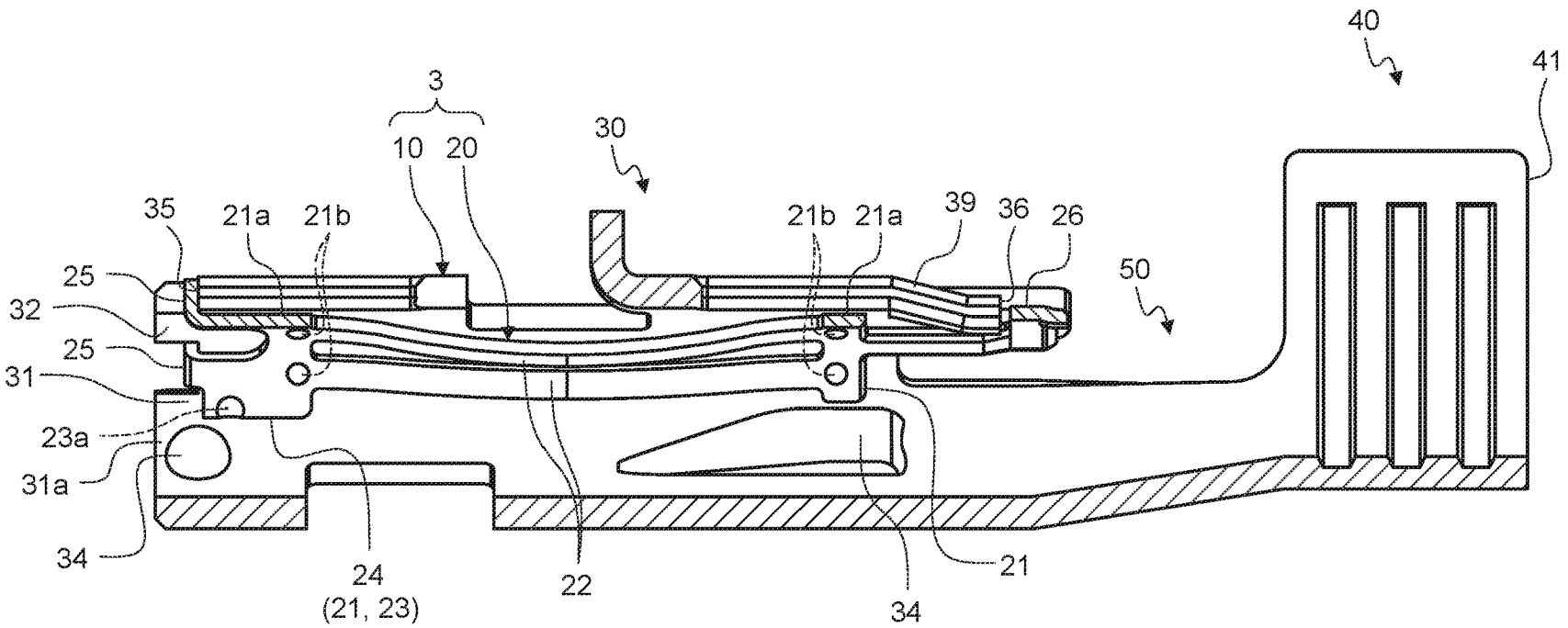
FIG. 14 is a Y-Y line sectional view of FIG. 11.

The female connector 30 of the present modification is formed in a cylindrical shape similarly to the female connector 30 of the specific example of the embodiment (FIG. 11 to FIG. 13). This female connector 30 includes four contacts 34 at places where the contact member 20 is not arranged on the inner circumferential face 32 (FIG. 12 and FIG. 14). In this example, four contacts 34 similar to the specific example of the embodiment are provided, and the male connector Tm1 inserted into the internal space 31 is held between the contact member 20 and the contacts 34.

The contact member 20 of the present modification is arranged on a side opposite to the specific example of the embodiment in the circumferential direction (a position deviated by substantially 180 degrees) in the internal space 31 and includes two first contacts 21 and four second contacts 22 coupling them to each other. One of the first contacts 21 is arranged on the opening 31*a* side, whereas the other thereof is arranged on the coupler 50 side in the internal space 31. The second contacts 22 are arranged at substantially regular intervals in the circumferential direction of the first contacts 21. In this contact member 20, the first contact 21 on the opening 31*a* side and the floating inhibiting part 23 are provided as one arcuate body 24 obtained by integrating them with each other similarly to the contact member 20 of the specific example of the embodiment (FIG. 13). This arrangement of the contact member 20 in the circumferential direction of the internal space 31 is not necessarily limited to the mode of the present modification and may be similar to that of the embodiment.

The outer circumferential face 21*a* of the arcuate body 24 of the present modification is provided with the first and second force applying parts 23*a* and 23*b* of the floating inhibiting part 23 in addition to the contacts 21*b* of the first contacts 21. The first and second force applying parts 23*a* and 23*b* of the present modification are formed as spherical swelled parts swelled outward in the radial direction from the outer circumferential face 21*a*. The arcuate body 24 of the present modification is formed so as to have a central angle with respect to an arc, which is larger than 180 degrees as described below and provides the first force applying point 23*a* at one end in the circumferential direction and provides the second force applying point 23*b* at the other end in the circumferential direction. In the present modification, such first and second force applying parts 23*a* and 23*b* are provided, and a contact with the first force applying point 23*a* on the inner circumferential face 32 of the female connector 30 is the first receiving part 33*a*, whereas a contact with the second force applying point 23*b* on the inner circumferential face 32 is the second receiving part 33*b* (FIG. 12). In the arcuate body 24, a first virtual line segment connecting its center and the first receiving part 33*a* and a second virtual line segment connecting its center and the second receiving part 33*b* are set, and the first and second force applying parts 23*a* and 23*b* are formed so as to make the angle between the first virtual line segment and the second virtual line segment larger than 180 degrees, for example. Further, the first force applying point 23*a* and the second force applying point 23*b* set their swelled amounts, for example, so as to enable respective pressing forces to be applied to the first receiving part 33*a* and the second receiving part 33*b*, respectively.

In this contact member 20, the arcuate body 24 is formed so as to have a central angle with respect to an arc which is larger than 180 degrees, whereas the first contact 21 on the coupler 50 side is formed so as to have a central angle with respect to an arc of substantially 180 degrees. The size of the arc of the arcuate body 24 sets its central angle to the extent of not being an annular ring. Consequently, in this contact member 20, its physical size on the coupler 50 side of the arcuate body 24 has a central angle with respect to an arc of substantially 180 degrees and is not cylindrically shaped. Consequently, in this connection terminal 3, the contact member 20 can be inserted into the internal space 31 with the amount of change in curvature reduced similarly to the connection terminal 1 of the specific example of the embodiment. Consequently, this connection terminal 3 can improve its durability and productivity.

Specifically, in this connection terminal 3, when the contact member 20 is accommodated into the internal space 31, with the curvature of the first contact 21 on the coupler 50 side made larger to make it narrower, this first contact 21 is inserted from the opening 31*a*, and then with the curvature of the arcuate body 24 having the function of the floating inhibiting part 23 made larger to generate a resilient force, this arcuate body 24 is inserted from the opening 31*a*, for example. Consequently, after being accommodated into the internal space 31, the arcuate body 24 decreases in curvature to return to its original form and applies respective pressing forces outward in the radial direction to the first receiving part 33*a* and the second receiving part 33*b* from the first force applying point 23*a* and the second force applying point 23*b*, respectively.

The reaction force against the pressing force acts on the first force applying point 23*a* of the arcuate body 24 from the first receiving part 33*a*, whereas the reaction force against the pressing force acts on the second force applying point 23*b* from the second receiving part 33*b*. With these reaction forces, a force in a pressing direction toward the inner circumferential face 32 of the female connector 30 is generated in this arcuate body 24. Consequently, the contact member 20 inhibits the floating of the arcuate body 24 (the first contact 21 on the opening 31*a* side and the floating inhibiting part 23) relative to the inner circumferential face 32 and also inhibits the floating of the second contacts 22 and the first contact 21 on the coupler 50 side relative to the inner circumferential face 32 accordingly. Consequently, this connection terminal 3 can inhibit the floating of the contact member 20 relative to the inner circumferential face 32.

The connection terminal 3 of the present modification includes the positional deviation inhibiting structure of the contact member 20 when the male terminal is inserted and the positional deviation inhibiting structure of the contact member 20 when the male terminal is removed described below. The positional deviation inhibiting structure of the contact member 20 when the male terminal is inserted is configured similarly to that of the connection terminal 1 of the specific example of the embodiment. However, in the present modification, the contact member 20 is provided with three first locked parts 25, and the female connector 30 is provided with three insertion direction locking parts 35 corresponding to the three first locked parts 25. The positional deviation inhibiting structure of the contact member 20, when the male terminal is removed, is configured as follows by the second locked part 26 provided in the contact member 20 and the removal direction locking part 36 provided in the female connector 30.

The second locked part 26 of the present modification is provided at the end on the coupler 50 side of the contact member 20. In this example, an arcuate part arranged to be spaced apart from the first contact 21 on the coupler 50 side in the axial direction is used as the second locked part 26 (FIG. 13). On the other hand, the female connector 30 of the present modification includes an inclined part 39 inclined inward in the radial direction at the end on the coupler 50 side. In this example, an end face on the coupler 50 side of the inclined part 39 is used as the removal direction locking part 36. Consequently, the contact member 20 of the present modification includes a through hole 27 into which the inclined part 39 is inserted after the accommodation of the contact member 20 into the internal space 31 between the first contact 21 on the coupler 50 side and the second locked part 26. In this positional deviation inhibiting structure of the contact member 20 when the male connector is removed, when the male connector Tm1 is removed from the internal space 31 toward the opening 31*a*, even if the contact member 20 attempts to move relative to the female connector 30 by a frictional force or the like with the male connector Tm1, the arcuate part as the second locked part 26 is locked by the end face on the coupler 50 side of the inclined part 39 (the removal direction locking part 36), and the contact member 20 can be locked to the predetermined position of the internal space 31. Consequently, this positional deviation inhibiting structure can inhibit the positional deviation of the contact member 20 in the axial direction relative to the internal space 31. Further, this positional deviation inhibiting structure can also inhibit the positional deviation of the contact member 20 in the circumferential direction relative to the female connector 30 by narrowing respective gaps between respective side walls in the circumferential direction of the through hole 27 and the inclined part 39.

The connection terminal according to the present embodiment can inhibit the floating of the contact member relative to the inner circumferential face of the female connector and can thereby, when the male connector is inserted into the internal space of the female connector, avoid the collision of this male connector with the contact member and enables a pushing operation on the second contacts outward in the radial direction by this male connector. Consequently, this connection terminal not only enables respective pieces of electric connection between the female connector and the contact member and between the male connector and the contact member but also can improve the durability of the contact member. In addition, this connection terminal can improve not only its own durability but also the durability of the male connector.

Although the invention has been described with respect to the specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal comprising:

a terminal main body that is made of a conductive material and has a female connector provided with a cylindrical internal space into which a male connector of a counter male terminal is inserted and a wire connector to which a conducting part of a wire is electrically connected; and a contact member that is made of a conductive material, is accommodated into the internal space along an inner circumferential face of the female connector and is electrically connected to the female connector, and is electrically connected to the male connector inserted into the internal space, wherein the contact member includes:

a first contact that is formed in an arcuate shape in a circumferential direction of the inner circumferential face of the female connector and is electrically connected to the inner circumferential face of the female connector on an outer circumferential face side of the arcuate shape;

a second contact that is arranged in the internal space while being coupled to the first contact, is pushed outward in a radial direction of the internal space by the male connector inserted into the internal space, and is electrically connected to the male connector; and a floating inhibiting part that is formed in an arcuate shape in the circumferential direction of the inner circumferential face of the female connector, and that applies a pressing force corresponding to a resilient force generated according to a change in a curvature of the arcuate shape to the female connector, generates a force in a pressing direction toward the inner circumferential face of the female connector by input of a reaction force from the female connector against the pressing force, and inhibits floating of the first contact relative to the inner circumferential face of the female connector using the force in the pressing direction, the contact member has at least two first contacts arranged to be spaced apart from each other in an axial direction of the female connector and has a plurality of second contacts as coupling parts that couple two adjacent first contacts, and the second contacts are formed in an arcuate shape protruding inward in the radial direction between the two adjacent first contacts so as to be bent outward in the radial direction when being pushed outward in the radial direction by the male connector inserted into the internal space.

2. The connection terminal according to claim 1, wherein the contact member has at least one of first locked part and at least one second locked part, that are configured to protrude outward in the radial direction, and the female connector has an insertion direction locking part that locks the first locked part in an insertion direction of the male connector relative to the internal space and a removal direction locking part that locks the second locked part in a removal direction of the male connector relative to the internal space.

3. The connection terminal according to claim 2, wherein the female connector includes a first receiving part that locks a first force applying part at one end in the circumferential direction of the floating inhibiting part and receives the pressing force from the first force applying part and applies the reaction force against the pressing force to the first force applying part, and a second receiving part that locks a second force applying part at another end in the circumferential direction of the floating inhibiting part and receives the pressing force from the second force applying part and applies the reaction force against the pressing force to the second force applying part.

4. The connection terminal according to claim 1, wherein the female connector includes a first receiving part that locks a first force applying part at one end in the circumferential direction of the floating inhibiting part and receives the pressing force from the first force applying part and applies the reaction force against the pressing force to the first force applying part, and a second receiving part that locks a second force applying part at another end in the circumferential direction of the floating inhibiting part and receives the pressing force from the second force applying part and applies the reaction force against the pressing force to the second force applying part.

5. The connection terminal according to claim 4, wherein the floating inhibiting part has the first force applying part configured to protrude outward in the radial direction from the one end in the circumferential direction and the second force applying part configured to protrude outward in the radial direction from the other end in the circumferential direction, and the floating inhibiting part is accommodated into the internal space with the curvature made smaller to generate the resilient force and applies the respective pressing forces in the circumferential direction to the first receiving part and the second receiving part from the first force applying point and the second force applying point, respectively.

6. The connection terminal according to claim 4, wherein the floating inhibiting part is formed so as to have a central angle with respect to an arc, which is larger than 180 degrees and has the first force applying part configured to protrude outward in the radial direction from the one end in the circumferential direction and the second force applying part configured to protrude outward in the radial direction from the other end in the circumferential direction, and the floating inhibiting part is accommodated into the internal space with the curvature made larger to generate the resilient force and applies the respective pressing forces in the circumferential direction to the first receiving part and the second receiving part from the first force applying point and the second force applying point, respectively.

7. The connection terminal according to claim 4, wherein the floating inhibiting part is formed so as to have a central angle with respect to an arc, which is larger than 180 degrees and has the first force applying part swelled outward in the radial direction at the one end in the circumferential direction and the second force applying part swelled outward in the radial direction at the other end in the circumferential direction, and the floating inhibiting part is accommodated into the internal space with the curvature made larger to generate the resilient force and applies the respective pressing forces outward in the radial direction to the first receiving part and the second receiving part from the first force applying point and the second force applying point, respectively.

8. A connection terminal comprising:

a terminal main body that is made of a conductive material and has a female connector provided with a cylindrical internal space into which a male connector of a counter male terminal is inserted and a wire connector to which a conducting part of a wire is electrically connected; and a contact member that is made of a conductive material, is accommodated into the internal space along an inner circumferential face of the female connector and is electrically connected to the female connector, and is electrically connected to the male connector inserted into the internal space, wherein the contact member includes:

a first contact that is formed in an arcuate shape in a circumferential direction of the inner circumferential face of the female connector and is electrically connected to the inner circumferential face of the female connector on an outer circumferential face side of the arcuate shape;

a second contact that is arranged in the internal space while being coupled to the first contact, is pushed outward in a radial direction of the internal space by the male connector inserted into the internal space, and is electrically connected to the male connector; and a floating inhibiting part that is formed in an arcuate shape in the circumferential direction of the inner circumferential face of the female connector, and that applies a pressing force corresponding to a resilient force generated according to a change in a curvature of the arcuate shape to the female connector, generates a force in a pressing direction toward the inner circumferential face of the female connector by input of a reaction force from the female connector against the pressing force, and inhibits floating of the first contact relative to the inner circumferential face of the female connector using the force in the pressing direction, the contact member has at least one first locked part and at least one second locked part, that are configured to protrude outward in the radial direction, and the female connector has an insertion direction locking part that locks the first locked part in an insertion direction of the male connector relative to the internal space and a removal direction locking part that locks the second locked part in a removal direction of the male connector relative to the internal space.

9. A connection terminal comprising:

a terminal main body that is made of a conductive material and has a female connector provided with a cylindrical internal space into which a male connector of a counter male terminal is inserted and a wire connector to which a conducting part of a wire is electrically connected; and a contact member that is made of a conductive material, is accommodated into the internal space along an inner circumferential face of the female connector and is electrically connected to the female connector, and is electrically connected to the male connector inserted into the internal space, wherein the contact member includes:

a first contact that is formed in an arcuate shape in a circumferential direction of the inner circumferential face of the female connector and is electrically connected to the inner circumferential face of the female connector on an outer circumferential face side of the arcuate shape;

a second contact that is arranged in the internal space while being coupled to the first contact, is pushed outward in a radial direction of the internal space by the male connector inserted into the internal space, and is electrically connected to the male connector; and a floating inhibiting part that is formed in an arcuate shape in the circumferential direction of the inner circumferential face of the female connector, and that applies a pressing force corresponding to a resilient force generated according to a change in a curvature of the arcuate shape to the female connector, generates a force in a pressing direction toward the inner circumferential face of the female connector by input of a reaction force from the female connector against the pressing force, and inhibits floating of the first contact relative to the inner circumferential face of the female connector using the force in the pressing direction, the female connector includes a first receiving part that locks a first force applying part at one end in the circumferential direction of the floating inhibiting part and receives the pressing force from the first force applying part and applies the reaction force against the pressing force to the first force applying part, and a second receiving part that locks a second force applying part at another end in the circumferential direction of the floating inhibiting part and receives the pressing force from the second force applying part and applies the reaction force against the pressing force to the second force applying part.

* * * * *